United States Patent [19]

Knepler

[11] Patent Number: 4,978,833

[45] Date of Patent: Dec. 18, 1990

[54] HOT WATER DISPENSER HAVING IMPROVED WATER TEMPERATURE CONTROL SYSTEM

[75] Inventor: John T. Knepler, Chatham, Ill.

[73] Assignee: Bunn-O-Matic Corporation, Springfield, Ill.

[21] Appl. No.: 302,797

[22] Filed: Jan. 27, 1989

[51] Int. Cl.[5] ..... H05B 3/78; F24H 1/20

[52] U.S. Cl. ..... 392/449; 99/281; 392/402

[58] Field of Search ..... 219/308, 306, 297, 298, 219/321, 314, 506; 99/281, 288, 295

[56] References Cited

U.S. PATENT DOCUMENTS

| | | | |
|---|---|---|---|
| 3,133,671 | 5/1964 | Christine et al. | 219/314 |
| 3,385,201 | 5/1968 | Martin | 99/282 |
| 3,392,266 | 7/1968 | Stahler | 219/321 |
| 3,523,178 | 8/1970 | Spensley et al. | 219/330 |
| 3,526,272 | 9/1970 | Watts et al. | 165/39 |
| 3,596,588 | 8/1971 | Moss | 99/295 |
| 3,678,247 | 7/1972 | Sawa et al. | 219/501 |
| 3,793,934 | 2/1974 | Martin | 99/282 |
| 3,821,516 | 6/1974 | Hayes et al. | 219/497 |
| 3,978,778 | 9/1976 | Roberts | 99/281 |
| 3,989,928 | 11/1976 | Scragg et al. | 219/334 |
| 4,413,552 | 11/1983 | Daugherty | 99/297 |
| 4,531,046 | 7/1985 | Stover | 219/297 |
| 4,551,611 | 11/1985 | Longo | 219/506 |
| 4,638,147 | 1/1987 | Dytch et al. | 219/306 |
| 4,641,012 | 2/1987 | Roberts | 219/308 |
| 4,757,182 | 7/1988 | Albright | 219/306 |
| 4,818,845 | 4/1989 | Koizumi et al. | 219/306 |

FOREIGN PATENT DOCUMENTS

| | | | |
|---|---|---|---|
| 2243720 | 3/1973 | Fed. Rep. of Germany | 219/306 |
| 52-53540 | 4/1977 | Japan | 219/321 |
| 82/03115 | 9/1982 | PCT Int'l Appl. | 219/308 |
| 2151050 | 7/1985 | United Kingdom | 219/306 |

*Primary Examiner*—Geoffrey S. Evans
*Attorney, Agent, or Firm*—Richard Bushnell

[57] ABSTRACT

A hot water dispenser includes a hot water reservoir, a user-actuated faucet for drawing hot water from an outlet zone near the top of the reservoir, and a solenoid-actuated valve for admitting unheated water to an inlet zone at the bottom of the reservoir. An inline flow regulator establishes an inlet flow rate less than the faucet flow rate to maximize the volume of hot water available at the faucet. An electric resistance heating element within the reservoir is supplied with AC current through a series-connected bilateral switch device which is periodically switched on and off in accordance with the temperature of water sensed by a sensor at the faucet to maintain a constant dispensing temperature. The switch device is thermally coupled to the bottom of the reservoir such that the reservoir acts as a heat sink to dissipate heat generated during switching. An indicator lamp conditioned by the sensor confirms to the user that the dispensing temperature is within a predetermined range.

13 Claims, 5 Drawing Sheets

FIG. 1
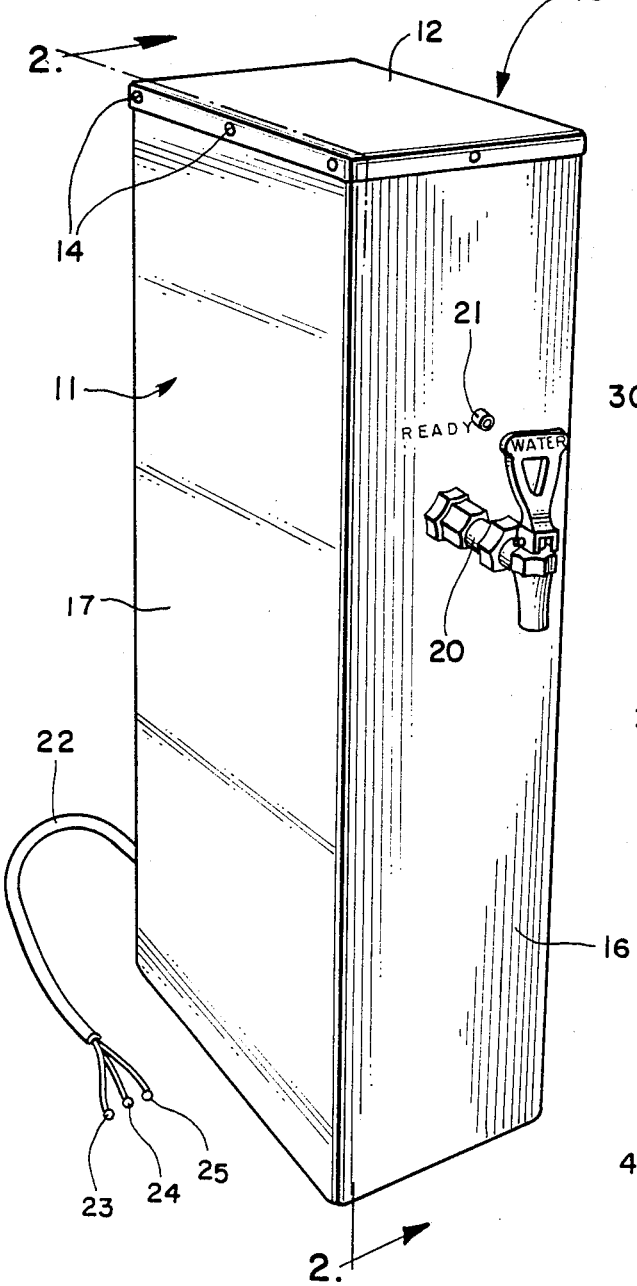
FIG. 5
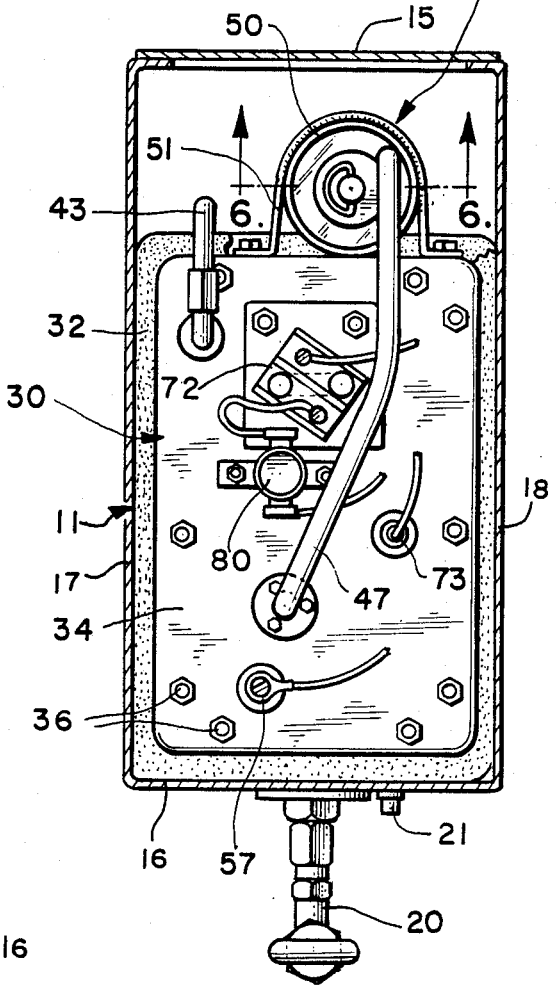
FIG. 6
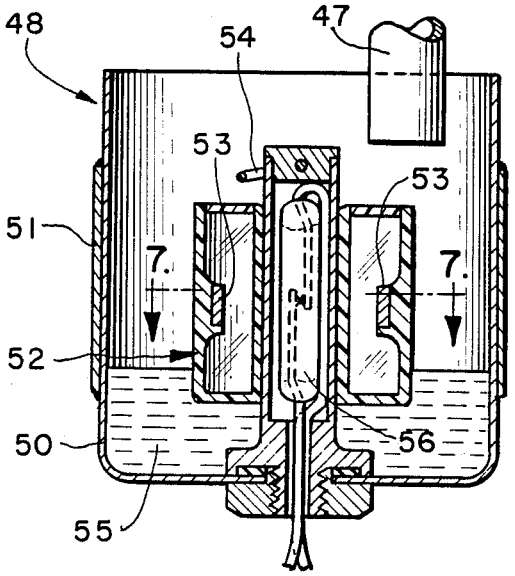
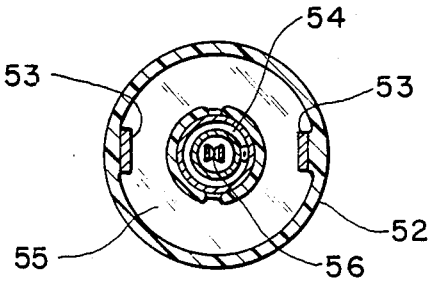
FIG. 7

10
47
OVERFLOW CONDUIT
72
73
12
14
34
36
5.
5.
3.
43
35
71
46
33
48
SWITCH ASSEMBLY
135
21
50
57
PROBE
32
70
40
74
20
15
45
43
32
30
44
41
11
WATER SUPPLY
42
71
16
31
23
22
8.
78
76
8.
24
25
13
3.

FIG. 3
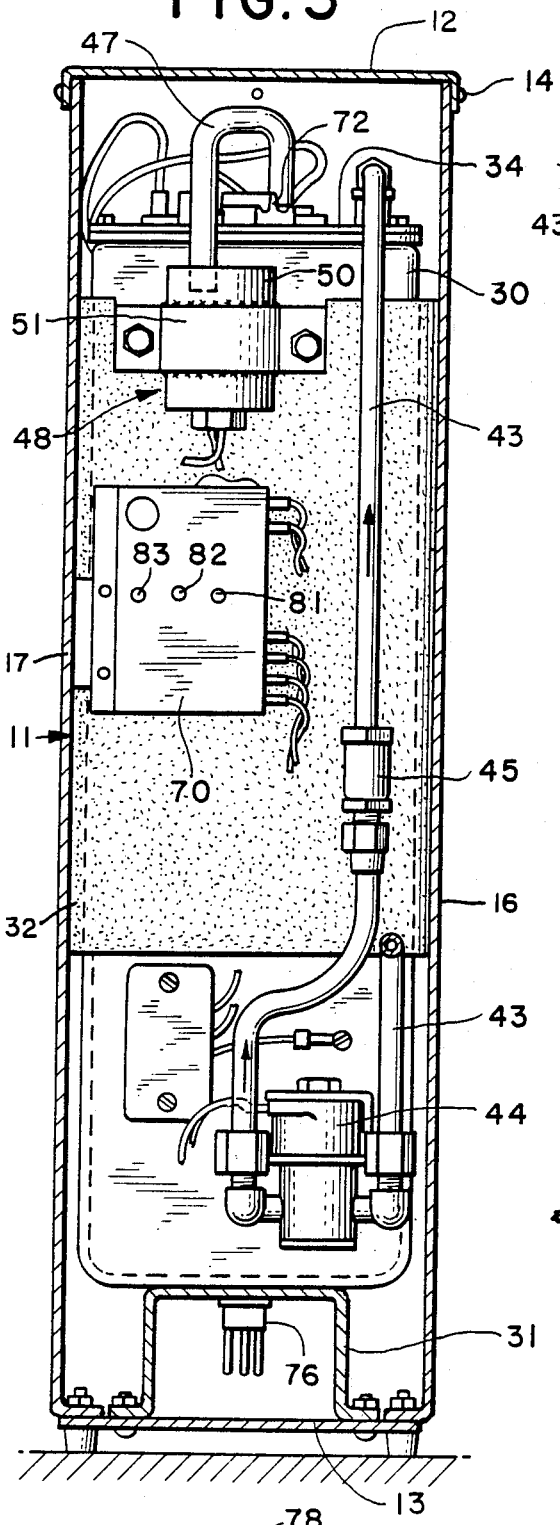
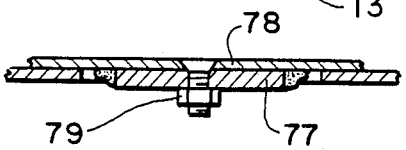
FIG. 9
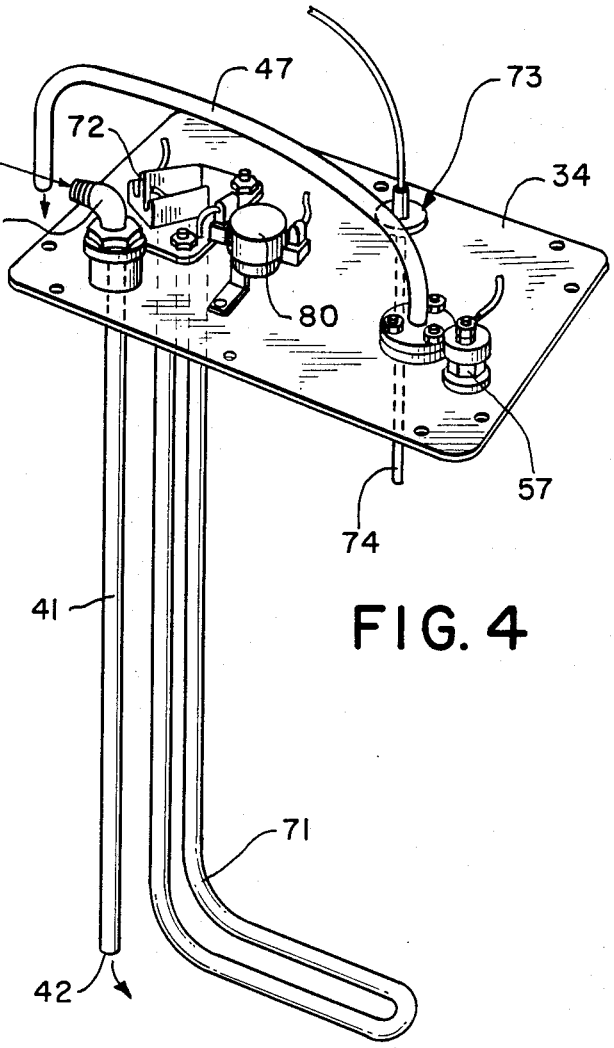
FIG. 4
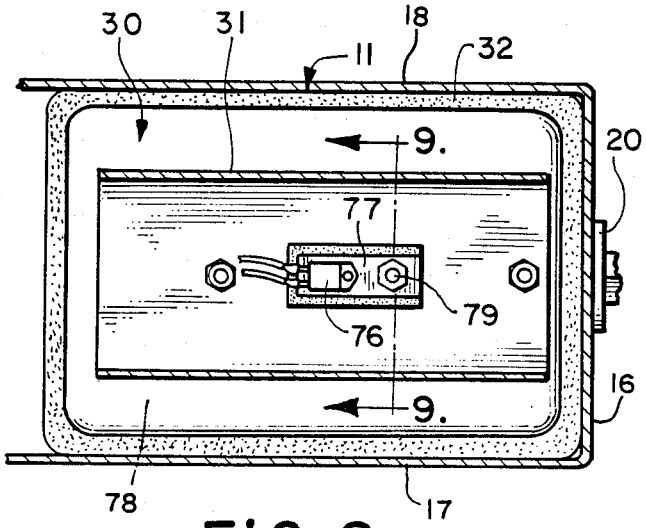
FIG. 8

L1
23
G
25
L2
24
48
45
44
SOL.
57
30
46
74
20
SAFETY SWITCH
INPUT
Tank
71
41
42
76
70
7
6
5
4
3
2
1
P1
P2
P4
P3
READY
21
84
81
TEMP. MODULE
READY TEMP. SELECT
CONTROL CIRCUITS
83

HOT WATER DISPENSER HAVING IMPROVED WATER TEMPERATURE CONTROL SYSTEM

BACKGROUND OF THE INVENTION

The present invention is directed generally to a hot water dispensing apparatus, and more particularly to a hot water dispenser for dispensing large volumes of hot water at a predetermined uniform temperature.

It is frequently desirable in restaurants and other commercial cooking establishments to have a source of hot water for various cooking purposes, such as the preparation of pastas, potatoes, gravies, soups and similar dishes, as well as for various cleaning purposes. To supply hot water for these and other purposes hot water dispensers have come into increasing use. Typically, these units employ a hot water reservoir in which water is heated by an electric resistance heater element. The application of electric current to the heating element is controlled by various means responsive to the temperature of the water in the reservoir, such as a thermostat, to achieve a predetermined dispensing temperature. One successful commercial version of such a hot water dispenser is the Model HW-5 Hot Water Machine manufactured by Bunn-0-Matic Corporation of Springfield, Ill., U.S.A.

In addition, various constructions of coffee brewers have been developed which include a reservoir in which water is heated to a predetermined brewing temperature and subsequently dispensed. For example, in the coffee maker described in U.S. Pat. No. 4,413,552 to Donald L. Daugherty, heated water is displaced from the top portion, or outlet zone, of a reservoir by cold water entering the bottom portion, or inlet zone of the reservoir, and discharged onto ground coffee or tea held in a brewer funnel lined with a disposable filter. The freshlY brewed coffee or tea discharged from the brewer funnel is collected in a serving beaker.

Cold water may be admitted in a determined volume to the reservoir of such a coffee maker to displace a like volume of heated water delivered to the brewing funnel. For example, in a pour-in type beverage brewer, such as that described in the afore-identified U.S. Pat. No. 4,413,552, a volume of cold water sufficient to produce the desired volume of beverage to be brewed is admitted to the bottom of the reservoir to displace an equal volume of hot water to the brewing funnel. In automatic type beverage brewers, such as described in U.S. Pat. No. 3,793,934, a valve is opened by electrical or manual means to periodically deliver predetermined batches of like volume of cold water to the apparatus.

An improved temperature control system for such coffee brewers is shown in U.S. Pat. No. 4,531,046 to Kenneth W. Stover, wherein an electronic temperature regulating circuit is utilized in conjunction with a thermistor suspended within a hollow copper tube in a central serving zone of a reservoir to control the application of current to a resistance heating element in the reservoir.

For maximum utility, a hot water dispenser must be capable of delivering hot water at a precisely controlled temperature in the face of widely varying demands. For example, a hot water dispenser may be suddenly called upon by one user to dispense large volumes of hot water for some occasional purpose, such as cleaning, and immediately thereafter be called upon by another user to dispense hot water for a different temperature-critical purpose such as cooking. Furthermore, in the event that the temperature of the dispensed water should ever fall below an acceptable level, it is desirable that the operator be immediately alerted to the unacceptable water temperature so that he can take appropriate action.

Since the hot water dispenser may be utilized in a restaurant where operating hours may be long and other heat producing equipment may be in close proximity, it is necessary that the dispenser function with a high degree of reliablity and independence from adverse operating environments. This has been difficult to achieve because of the adjacent heat producing apparatus, which make it difficult to adequately cool electrical components utilized for temperature control. Conventional cooling means, such as finned external heat sinks, are impractical because of the space they require and the difficulty they present when cleaning. The hot water dispenser of the present invention avoids this problem by utilizing the water filled reservoir of the dispenser as a heat sink for the critical electrical components.

The present invention provides a hot water dispenser which provides not only an increased volume of hot water at a predetermined temperature, but also an unambiguous indication to the user that water being dispensed is within a range of acceptable temperatures. Furthermore, it does this with improved efficiency and reliability, even in adverse operating environments.

Accordingly, it is a general object of the present invention to provide a new and improved hot water dispenser.

It is a more specific object of the present invention to provide a hot water dispenser which dispenses an increased volume of water at a predetermined dispensing temperature.

It is another specific object of the present invention to provide a hot water dispenser which provides an unambiguous indication to a user that hot water is being dispensed within a predetermined range of temperatures.

It is another specific object of the invention to provide a hot water dispensing apparatus which provides a high degree of reliability in the adverse operating environments often encountered in restaurants and other commercial establishments.

SUMMARY OF THE INVENTION

The invention is directed to a hot water dispensing apparatus comprising a hot water reservoir of predetermined volume having an inlet zone at the bottom end thereof and an outlet zone in an upper portion thereof, means including a resistance heating element within the reservoir operable from an applied electric current for heating water in the reservoir, inlet means for admitting cold water at a first predetermined flow rate into the inlet zone, and outlet means for discharging heated water at a second predetermined flow rate from the outlet zone. Temperature regulating means responsive to the temperature of water in the reservoir at the outlet means control the application of electrical current to the resistance heating element to maintain water at the outlet zone at a substantially constant temperature, the first flow rate being less than the second flow rate to maximize the volume of the outlet zone.

The invention is further directed to a hot water dispensing apparatus comprising a hot water reservoir means including a resistance heating element within the reservoir operable from an applied electric current for heating water in the reservoir, inlet means for admitting cold water into the reservoir and outlet means for discharging heated water from the reservoir. Temperature regulating means responsive to the temperature of water in the reservoir control the application of electric current to the resistance heating element to maintain the water in the outlet zone at a substantially constant predetermined temperature, the regulating means including a bilateral switching device in series-circuit relationship with the heating element, and the bilateral switching device in operation generating heat. Means are provided for thermally coupling the bilateral switching device to the reservoir whereby heat generated in the device is transferred to the reservoir.

The invention is further directed to a hot water dispensing apparatus comprising a hot water reservoir means including a resistance heating element within the reservoir operable from an applied electric current for heating water in the reservoir, an inlet port for admitting cold water into the reservoir, and an outlet port for discharging heated water from the reservoir. Temperature sensing means provide a sensing signal indicative of the temperature of the water in the reservoir at the discharge port, and an indicator responsive to the sensing signal indicates to a user that the water temperature at the outlet port is within a predetermined range.

The invention is further directed to a hot water dispensing apparatus comprising a hot water reservoir means including a resistance heating element within the reservoir operable from an applied electric current for heating water in the reservoir, inlet means for admitting cold water into the reservoir, and outlet means for discharging heated water from the reservoir. Temperature regulating means responsive to the temperature of water in the reservoir control the application of electric current to the resistance heating element to maintain the water in the reservoir at a substantially constant predetermined temperature, the temperature regulating means including a switch device in series-circuit relationship with the resistance heating element, and user-adjustable circuit means for periodically rendering the switch device conductive to control the temperature of water in the reservoir. Indicator means indicate to a user the cycling of the switch device between conductive and non-conductive states to confirm temperature equilibrium in the reservoir.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

FIG. 1 is a perspective view of a hot water dispenser constructed in accordance with the invention.

FIG. 3 is a rear cross-sectional view of the hot water dispenser taken along line 3—3 of FIG. 2.

FIG. 4 is a perspective view of a reservoir cover subassembly utilized in the hot water dispenser.

FIG. 5 is a top cross-sectional view of the hot water dispenser taken along line 5—5 of FIG. 2.

FIG. 6 is an enlarged cross-sectional view of the overflow detector of the hot water dispenser taken along 6—6 of FIG. 5.

FIG. 7 is a cross-sectional view of the float assembly of the overflow detector taken along line 7—7 of FIG. 6.

FIG. 8 is a bottom cross-sectional view of the hot water dispenser taken along line 8—8 of FIG. 2.

FIG. 9 is a cross-sectional view of the bottom wall of the reservoir utilized in the hot water dispenser taken along line 9—9 of FIG. 8.

DESCRIPTION OF THE PREFERRED EMBODIMENT

Figure 2:
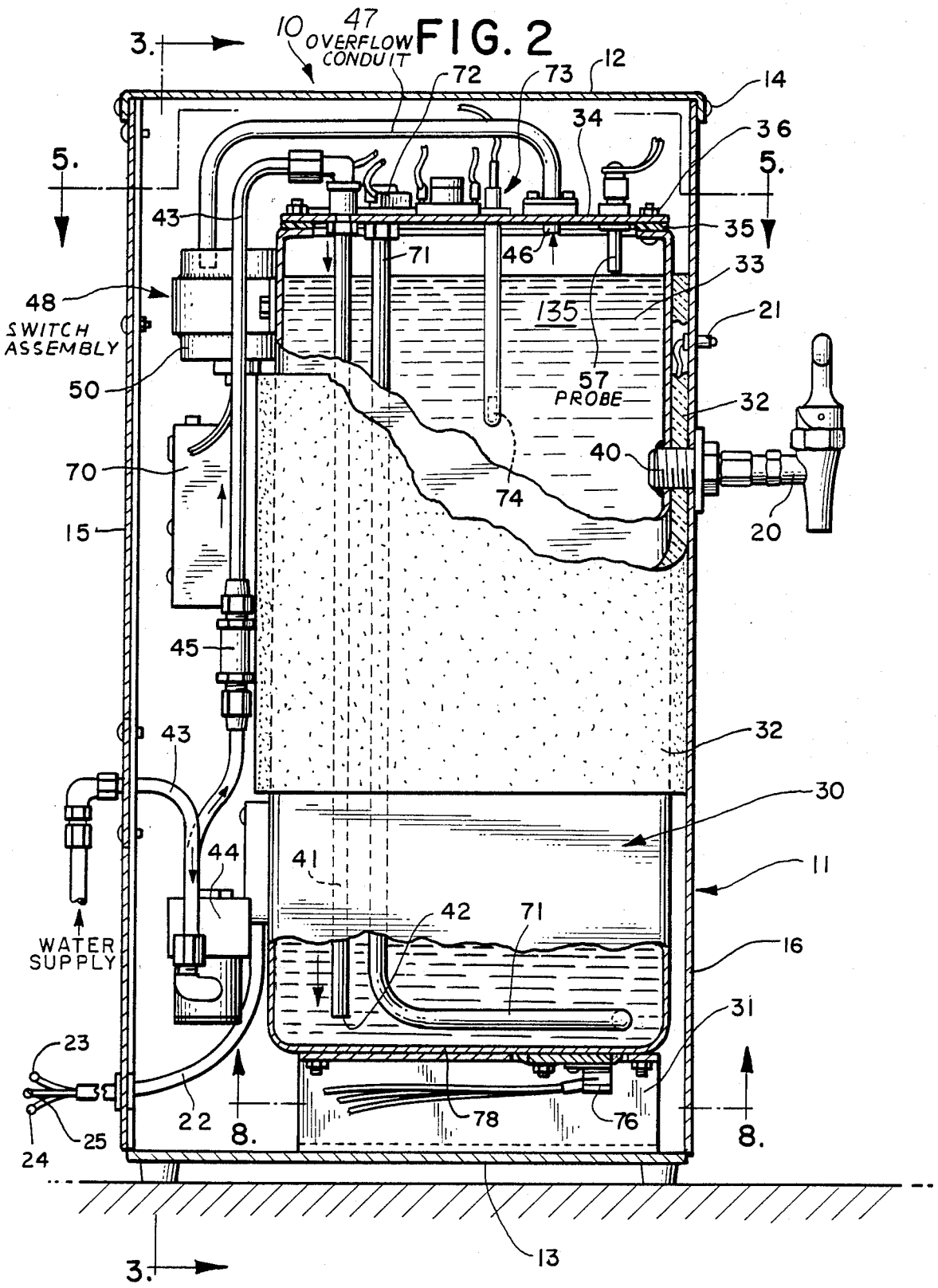
FIG. 2 is an enlarged side cross-sectional view taken along line 2—2 of FIG. 1 partially in section to show the principal components of the hot water dispenser.

Referring to the Figures, and particularly to FIGS. 1–3, a hot water dispenser 10 constructed in accordance with the invention is seen to include an outer housing 11 formed of stainless steel or other appropriate material. A removable cover 12 is provided at the top of the housing to provide access to the interior thereof for adjustment and servicing. A removable cover 13 (FIGS. 2 and 3) is provided at the bottom of housing 11 for the same purpose. A plurality of machine screws 14 may be provided to secure the removable top cover 12 in position. A rear panel 15 (FIG. 2) may be provided to enclose the rear of the housing. Overall, the housing 11 is preferably upstanding in form and includes vertically-elongated front, left side and right side panels 16, 17 and 18, respectively.

The front panel 16 of housing 11 is preferably provided with user-actuated outlet means 20 in the form of a conventional faucet assembly through which heated water may be drawn by a user from an upper portion or outlet zone 135 of a reservoir 30. A ready light 21 is preferably provided in close proximity to faucet 20 to indicate to the user that the water being drawn through the faucet is within an acceptable range of operating temperatures. Operating power is supplied to the hot water dispenser by a conventional electrical cable 22 extending from the rear panel of the dispenser and terminating with three connectors 23, 24 and 25, providing line $L_1$, line $L_2$ and ground connections, respectively.

Referring to FIG. 2, within housing 11 hot water dispenser 10 is seen to include a hot water reservoir 30 which comprises an elongated generally rectangular tank mounted in an upstanding position within the housing on a support bracket 31. A layer of insulating material 32 is provided around a substantial central portion of the hot water reservoir to provide a degree of thermal isolation for a volume of water 33 contained within the reservoir. The hot water reservoir 30 is preferably formed of a stainless steel and includes a removable top plate 34 secured over its open top end by a gasket 35 and plurality of machine screws 36. Gasket 35 forms a liquid-tight seal between top plate 34 and the side walls of reservoir 30. Faucet 20 extends through the front panel 16 of housing 11 and through the side wall of reservoir 30 so as to provide a hot water discharge port 40 at a location intermediate the top and bottom ends of housing 30. It is at this location that hot water is withdrawn from reservoir 30.

To provide for the introduction of unheated water into reservoir 30 the reservoir is provided with an internal conduit 41 which extends from cover plate 34 downwardly to the bottom portion of the reservoir, wherein the conduit terminates to provide an inlet port 42 adjacent an inlet zone at the bottom of the reservoir. Unheated water from an external water supply is provided to conduit 41 through an inline conduit 43, which includes a solenoid-actuated flow control valve 44 and an inline flow regulator 45.

In the event that reservoir 30 should be over-filled for any reason an overflow port 46 at the top end of the reservoir allows water to escape from the reservoir through a conduit 47 to an overflow safety switch assembly 48. As shown in FIG. 6, switch assembly 48 includes a generally cylindrical reservoir 50 mounted by a bracket 51 or other appropriate means to the rear wall of reservoir 30. Water overflowing from reservoir 30 through conduit 47 is discharged into reservoir 50. A float assembly 52 including one or more permanent magnets 53 is mounted for vertical movement on a center post assembly 54. As overflow water 55 is collected in reservoir 50 the float assembly rises permanent magnets 53 allow a reed switch 56 in the hub assembly to open and terminate the flow of water into reservoir 30. As shown in FIG. 7, the permanent magnets 53 are arranged in diametrically opposed positions on float assembly 52 such that the resultant magnetic field causes the contacts of reed switch 56 to close only when the float is seated at the bottom of the reservoir.

During normal operation the level of water 33 in reservoir 30 is maintained at a predetermined maximum level by a sensing probe assembly 57 which extends downwardly through top plate 34 to the surface of the water. The probe assembly 57 is connected to water level control circuitry within a control module 70 mounted on the rear wall of reservoir 30.

The water 33 in reservoir 30 is heated to a predetermined dispensing temperature by means of a conventional metallic-sheath type electric resistance heating element 71. As shown in FIGS. 2 and 4, this heating element 71 extends from top plate 34 downwardly within the reservoir, at the bottom end thereof being angled in a generally L-shaped configuration to provide additional heating for water entering the reservoir through inlet port 42. The heating assembly 71 is mounted by conventional means to top plate 34 and includes a conventional electrical connector assembly 72 which provides for electrical connections to an electrical current source. Temperature control is achieved by selectively applying current pulses to the heating element in accordance with the sensed temperature of the water 33 in the reservoir. This temperature is sensed by a temperature sensing probe assemblY 73 which extends from top plate 34 to a position adjacent discharge port 40. In the manner described in the aforementioned U.S. Pat. No. 4,531,046, a thermistor 74 or other appropriate temperature sensing component is provided within a heat-conductive copper tubing at the sensing location and connected to control module 70 by electrical conductors extending upwardlY through the tubing and top plate 34.

Circuitry within module 70 responds to the temperature-dependent resistance of thermistor 74 to periodically switch operating power on and off to resistance heating element 71. The rate of switching is dependent on the sensed temperature. For example, a temperature greater than 5°F. below the selected temperature causes the heating element to be continuously powered (i.e., 100% duty cycle), while a temperature within 5°F. of the selected temperature causes the heating element to be powered for a lesser time period, decreasing to approximately 10% at the selected temperature. When the water temperature sensed by thermistor 75 is higher than the desired temperature, resistance heating element 71 is not powered.

The actual switching of electrical power to heating element 71 is accomplished by a bilateral switching device in the form of a triac 76 in response to control signals generated by the temperature control circuitry within control module 70. As a result of being periodically switched on and off substantial heat dissipation occurs in triac 76 which, if not dissipated, would ultimately result in the destruction of that device. To provide for dissipation of this heat water dispenser 10 provides, in accordance with one aspect of the invention, that triac 76 be mounted in thermal communication with reservoir 30, preferably to the bottom wall thereof. Thus mounted, the heat generated within the triac during the switching operation is transferred to the relatively high heat capacity of the reservoir. This obviates the need on the exterior surface of housing 11 for a separate heat sink, which could present air circulation and cleaning problems for the user.

As shown in FIGS. 8 and 9, to avoid hot spots triac 76 may in accordance with conventional practice be mounted on a metallic block of copper 77 or other material having a high thermal conductivity. This block may, in turn, be mounted to the bottom wall 78 of the reservoir by a machine screw 79 or other appropriate mounting means. A heat conductive paste may be provided to assist in the thermal coupling of the triac to the reservoir.

As shown in FIG. 4, the top plate 34 together with the attached inlet conduit 41, resistance heating element 71, temperature probe 54 and level sensing probe 57 may be assembled as a subassembly for installation as a unit in the water reservoir. An over-temperature switch 80 may be mounted on top plate 34 and connected in series-circuit relationship with resistance heating element 71 to interrupt the application of power to the heating element in the event that an over-temperature condition is sensed at top plate 34.

In normal operation, as hot water is withdrawn from the reservoir through faucet 20 the water level in the reservoir drops. As a result, probe 57 no longer contacts the water and control module 70 causes solenoid actuated valve 44 to open. Water then flows into the reservoir through conduit 43 at a rate established by flow regulator 45. This flow rate, in accordance with one aspect of the invention, is lower than the flow rate through the faucet. Consequently, the water drawn through faucet 20 is primarily from an outlet zone 135 in the upper portion of the reservoir above the faucet, which water is at the desired dispensing temperature. As the water level drops the flow rate through the faucet drops, until the flow rate of the incoming water is eventually reached when the water level falls to the level of the faucet. Thus, hot water dispenser 10 provides the greatest possible volume of heated water at faucet 20 for the volume of the reservoir and the heating capacity of resistance heating element 71.

To preclude the inadvertent use of insufficiently heated water, a temperature probe assembly 73 provides a signal to control module 70 indicative of the water temperature in the outlet zone of faucet 40.

Within module 70 this signal is monitored and in the event that the temperature at faucet 20 falls outside of a predetermined operating range indicator lamp 21 is extinguished. Thus, should the user exceed the capacitY of hot water dispenser 10 indicator lamp 21 will be extinguished to alert the user to wait until the resistance heating element 71 has brought the water in the reservoir back to its operating temperature. In this way, the dispenser provides protection against the consequences of insufficiently heated water.

As shown in FIG. 3, control module 70 includes a potentiometer 81 for setting the nominal temperature at which hot water is dispensed. In accordance with another aspect of the invention, an LED indicator lamp 82 within module 70 viewable by the user lights to indicate those time periods in which the resistance heating element 71 is energized. This enables the user, by adjusting potentiometer 81 for short regular flashes corresponding to a duty period of approximately 10%, to adjust the temperature control circuit to a desired existing water temperature. A second potentiometer adjustment 83 provides for adjustment of the range or operating window of temperatures at which indicator lamp 21 is lit to indicate acceptable dispensing temperatures.

Figure 10:
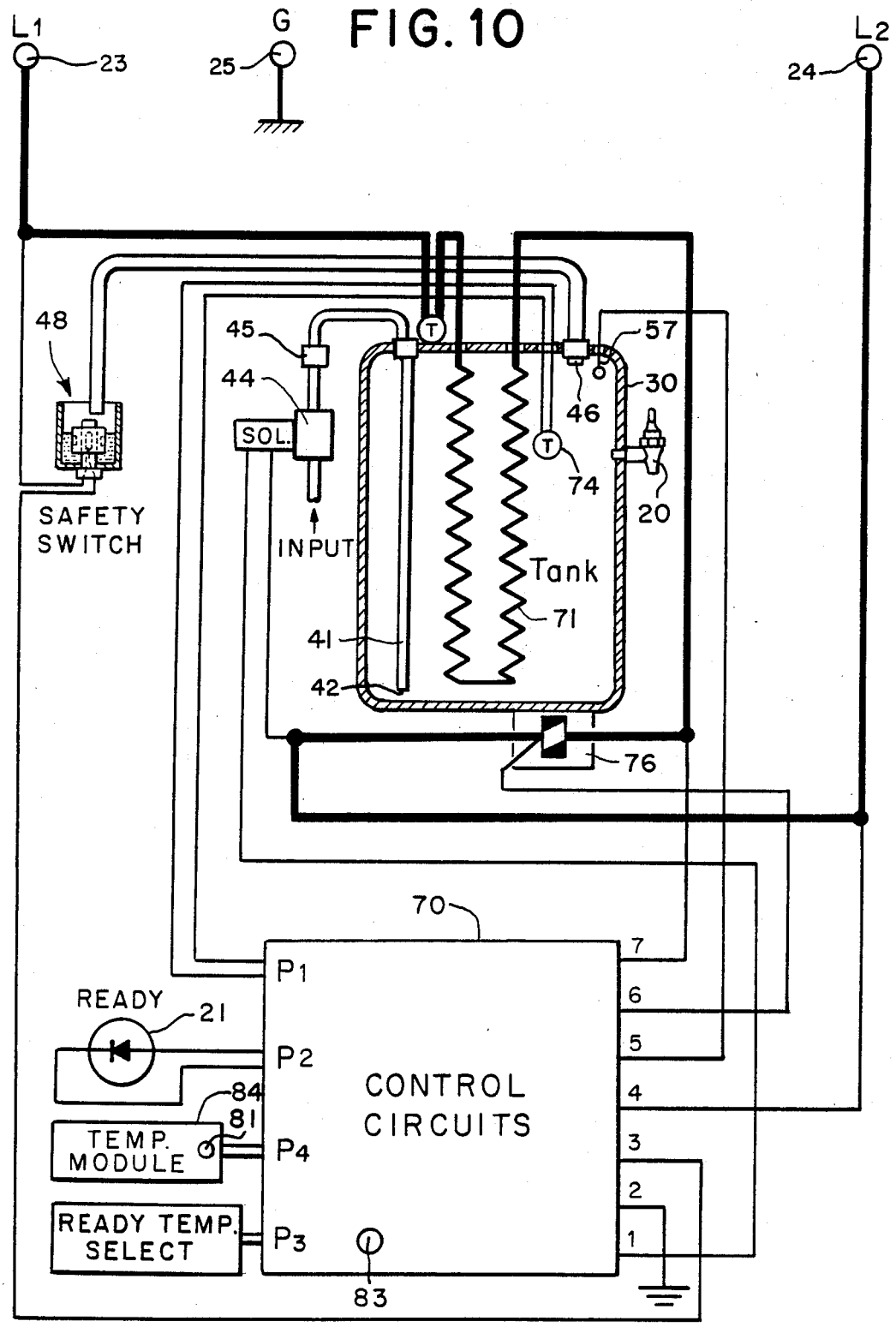
FIG. 10 is a simplified functional diagram partially in schematic form showing the principal components of the hot water dispenser.

Referring to FIG. 10, control circuits 70 are seen to include, in accordance with another aspect of the invention, a temperature control module 84 which can be interchanged on connector $P_4$ to permit operation in different temperature ranges. This allows potentiometer 81 to be adjustable over a relatively narrow range of temperatures selected by the temperature module 84, and therefore allows the operating temperature of the dispenser to be set with great accuracy. When changing temperatures outside of the existing range, a new temperature module is selected having a operating range which includes the newly desired temperature and the potentiometer associated with that module is then set by the user to accurately establish the new temperature at which hot water is to be dispensed.

A similar arrangement using a removable module 85 (FIG. 10) may be provided in association with socket $P_3$ to modify the range of temperatures over which indicator lamp 21 will light. Modules 84 and 85 may be contained within a housing of control circuit 70, appropriate access holes being provided in the cover of the module to provide for user adjustment. Similarly, indicator lamp 82 may be provided with an aperture to enable the lamp to be viewed by the user when making an adjustment to potentiometer 81.

Figure 11:
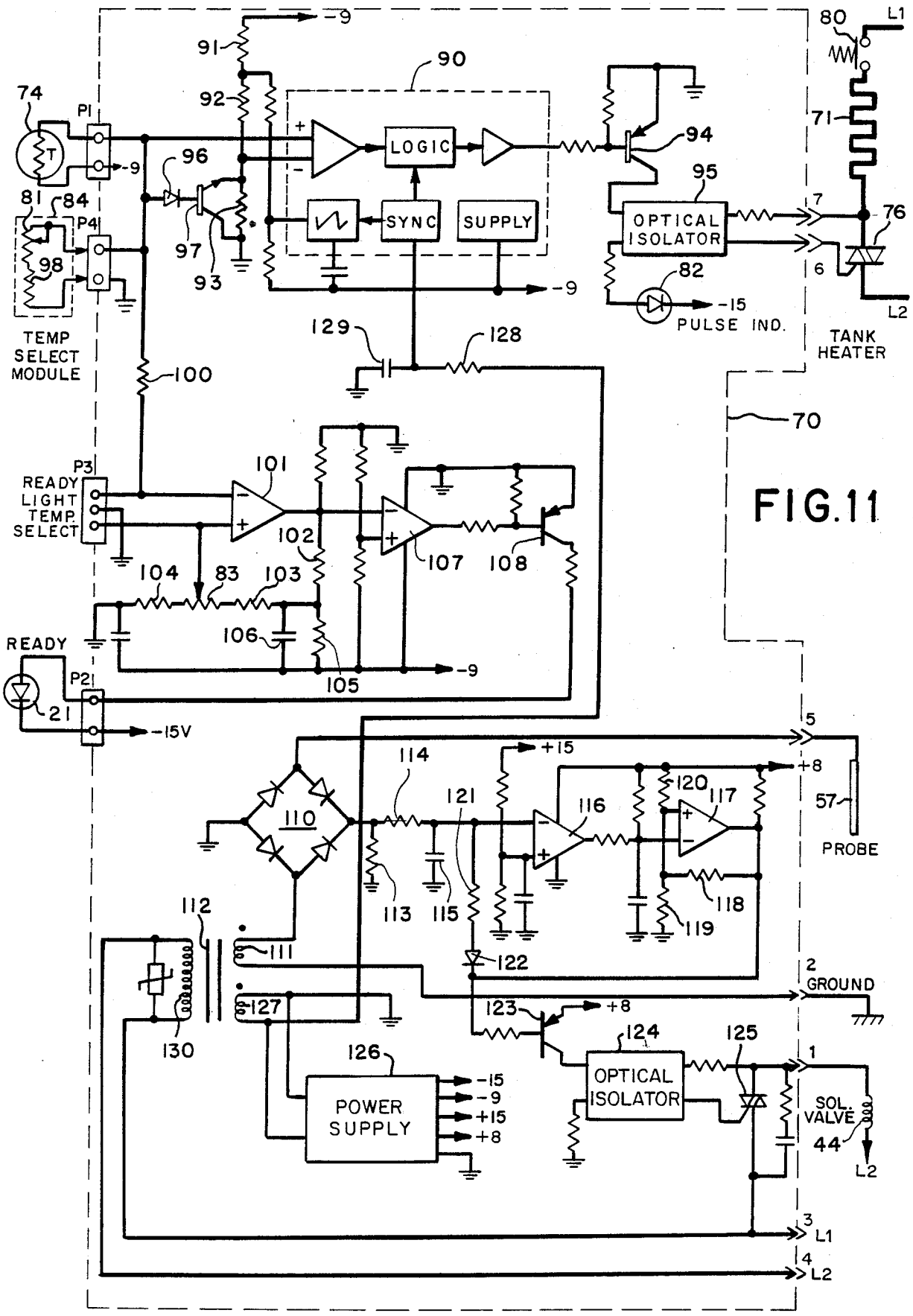
FIG. 11 is a simplified schematic diagram of the control circuitry utilized in the hot water dispenser of the invention.

Referring to FIG. 11, within the control circuit module 70 temperature control is accomplished by an integrated circuit 90, which may be a commercially available Telefunken (Trademark) type U217B zero-voltage switch circuit of conventional construction and operation. Basically, thermistor 74 is connected to the non-inverting input of a comparator amplifier within the integrated circuit. A reference voltage is applied to the inverting input of the differential amplifier by a voltage divider comprising resistors 91, 92 and 93. The integrated circuit operates in a conventional manner to generate zero-crossing pulses for application to triac 76 in accordance with the differential voltage existing at the differential amplifier. The output of integrated circuit 90 is applied through a transistor 94 to an optical isolator 95, wherein an amplified and isolated output signal is developed for application to the gate electrode of triac 76. LED indicator 82 is connected in series with the output of integrated circuit 90 to provide an indication that triac 76 is being pulsed to a conductive condition.

To prevent a continuous application of current to resistance heating element 71 in the event of an open circuit to thermistor 74 a diode 96 and transistor 97 are provided to form an open sensor protection circuit. Should thermistor 74 or its connections become open transistor 97 is biased into saturation, effectively connecting the non-inverting and inverting inputs of the differential amplifier of circuit 90 together and preventing the production of further control pulses to triac 76.

The temperature which will be maintained by heating element 71 is selected by potentiometer 81, which together with a fixed resistor 98 is contained on the removable temperature select module 84. Thermistor 74, potentiometer 81 and resistor 98 form a voltage divider which causes a portion of the −9 volt voltage applied to thermistor 74 to be applied to the non-inverting input of the differential amplifier of integrated circuit 90. Resistor 98 is selected relative to potentiometer 81 so that the potentiometer need only operate over a limited range which includes the desired operating temperature. In this way, the user, by adjusting potentiometer 81, can accurately set a particular operating temperature.

By reason of the temperature select module 84 being pluggable, a different operating range can be readily selected either at the factory during initial manufacture, or in the field, by plugging in a different module having a different combination of resistance for potentiometer 81 and fixed resistance 98 appropriate for the newly selected operating temperature.

To provide an indication to the user that water being drawn from faucet 20 is within a predetermined range of operating temperatures, thermistor 74 is also connected through a resistor 100 to the inverting input of a differential amplifier 101. The non-inverting input of this amplifier is connected to the arm of the range select potentiometer 83, which together with fixed resistors 102, 103, 104 and 105 forms part of a voltage divider between the −9 volt source of the module, the output of amplifier 101 and ground. A reference voltage is established at the arm of potentiometer 83, and hence at the non-inverting input of differential amplifier 101. Resistors 102 and 105 introduce positive feedback at the output of amplifier 101 which establishes a hysteresis of approximately 5°F. between temperatures at which the lamp is lighted and extinguished. Capacitor 106 introduces a desirable time constant.

The output of differential amplifier 101 is applied to the inverting input of a second differential amplifier 107, wherein it is inverted and amplified. The output of amplifier 107 is applied through a transistor 108 to indicator lamp 21 to indicate to the user that the water temperature at faucet 20 is within the selected operating range. Additional control of the operation of ready lamp 21 is possible through connector $P_3$, which provides direct connections to the inverting and non-inverting inputs of differential amplifier 101.

To provide for control of solenoid valve 44, the water level sensing probe 57 is connected to one input terminal of a full-wave bridge rectifier network 110. The other input of this network is connected through a secondary winding 111 of a power transformer 112 to ground, causing an AC voltage to be impressed across the bridge rectifier network when water in reservoir 30 rises to a level sufficient to establish electrical conductivity between probe 57 and ground. This voltage is rectified and applied through a filter network comprising resistors 113 and 114 and capacitor 115 to the inverting input of a differential amplifier 116. This amplifier amplifies the rectified signal, and applies the amplified signal to the inverting input of an additional differential amplifier 117, wherein it is inverted and further amplified. A feedback network comprising resistors 118, 119 and 120 provide positive feedback to establish a bi-stable switching condition at valve 44. A resistor 121 and diode 122 connected between the output of amplifier 117 and the inverting input of amplifier 116 are provided to further this purpose.

The output of amplifier 117 is applied through a transistor 123 to a conventional optical isolator 124, which provides in the presence of an output signal from the amplifier an appropriate signal to the gate electrode of a triac 125. This device connects one side $L_1$ of the AC line to solenoid valve 44 to actuate the valve and admit unheated water to reservoir 30. This continues until the water rises to the level of probe 57 at which time the alternating current applied to bridge rectifier network 110 causes amplifiers 116 and 117 to be driven into cut-off and the gate signal to be removed from triac 125.

The various negative polarity and positive polarity voltages required by the circuitry of control module 70 may be provided by a conventional power supply circuit 126. This circuit receives alternating current from a secondarY winding 127 of power transformer 112. One terminal of winding 127 is connected to ground and the other terminal is connected through a network comprising a resistor 128 and capacitor 129 to synchronize the operation of the zero-crossing switch circuit contained within integrated circuit 90. The primary winding 130 of transformer 112 may be connected to the AC line ($L_1$ and $L_2$) utilized to power the hot water dispenser.

Thus, a compact unitary module 70 is utilized to provide all basic control functions of the hot water dispenser. The inputs and outputs of this module are connected directly to the associated sensing and actuator components of the dispenser. This provides an arrangement well suited for efficient and economical manufacture.

By reason of all components being contained within the stainless steel housing of the dispenser, the dispenser is particularly well suited for use in close proximity to other heat producing appliances. In particular, by reason of triac 76 being attached to the bottom of reservoir 30 the need for an external heat sink is obviated. Ambient conditions are not a factor in the performance of this heat sink because heat is dissipated in the water contained within the reservoir, and not in the air. An additional advantage is that the energy lost in the triac is recaptured to heat the water instead of to heat room air.

This advantage holds even when the hot water dispenser is set for a high operating temperature, such as 208° F., and the case temperature of a triac must be kept below a typical 190° F. maximum operating temperature. The heat sink still functions to protect the triac because the water temperature at the bottom of the tank is always cooler than that in the vicinity of the faucet or the outlet zone 135 and the upper portion of the reservoir 30. This is due to the natural tendency of heated water to rise within the reservoir as the denser unheated water falls to the bottom. Moreover, when the tub water reaches the desired temperature the triac is operating at a very low duty cycle so its internally generated heat is insignificant.

Maximum heat is generated within the triac when it is fully on, i.e., 100% duty cycle. This occurs only when cold water is introduced into the dispenser which must be heated to the operating temperature. However, in this circumstance incoming cold water is directed to the bottom of the tank and thus extracts energy from the triac, so that even when the triac is operating at maximum dissipation the water provides maximum cooling.

The level of faucet 20 is preferably several inches below the nominal water level in the reservoir. Since the reservoir is not pressurized the output flow rate from the reservoir is dependent on the water height above the faucet. When the water level falls below the sensing probe the refill circuit energizes solenoid valve 44, allowing water to enter the tank through flow regulator 45. The flow regulator is set such that hot water present above the faucet level tends to remain there because incoming cold water flows at a slower rate than the rate from the faucet. The flow regulator allows the faucet flow to outrun the incoming water so the hot water in the outlet zone 135 in the upper portion of the reservoir is utilized.

While a particular embodiment of the invention has been shown and described, it will be obvious to those skilled in the art that changes and modifications may be made therein without departing from the invention in its broader aspects, and, therefore, the aim in the appended claims is to cover all such changes and modifications as fall within the true spirit and scope of the invention.

I claim:

1. A hot water dispensing apparatus comprising:

a hot water reservoir including an inlet zone at the bottom end thereof and an outlet zone in an upper portion thereof;

means including a resistance heating element within said reservoir operable from an applied electric current for heating water in said reservoir;

inlet means for admitting cold water at a first predetermined flow rate into said inlet zone;

outlet means for discharging heated water at a second predetermined flow rate from said outlet zone;

temperature regulating means responsive to the temperature of water in said reservoir at said outlet means for controlling the application of electrical current to said resistance heating element to maintain water in said outlet zone at a substantially constant temperature; and said first predetermined flow rate being less than said second predetermined flow rate to maximize the volume of said outlet zone.

2. A hot water dispenser apparatus as defined in claim 1 wherein said outlet means comprise a user-actuated faucet.

3. A hot water dispenser apparatus as defined in claim 2 wherein said inlet means include a flow regulator for establishing said first predetermined flow rate.

4. A hot water dispenser apparatus as defined in claim 3 wherein said second predetermined flow rate comprises the gravity flow rate of said faucet.

5. A hot water dispensing apparatus comprising:

a hot water reservoir;

means including a resistance heating element within said reservoir operable from an applied electric current for heating water in said reservoir;

inlet means for admitting cold water into said reservoir;

outlet means for discharging heated water from said reservoir;

said inlet means including flow regulating means for controllably admitting water to said reservoir at a first predetermined flow rate and said outlet means controllably discharging water from said reservoir at a second predetermined flow rate, said first predetermined flow rate being less than said second predetermined flow rate;

temperature regulating means responsive to the temperature of water in said reservoir for controlling the application of electric current to said resistance heating element to maintain the water in said reservoir at a substantially constant predetermined temperature;

said regulating means including a current switching device in series-circuit relationship with said resistance heating element;

said current switching device in operation generating heat; and means for thermally coupling said current switching to said reservoir whereby heat generated in the operation of said device is transferred to said reservoir.

6. A hot water dispensing apparatus as defined in claim 5 wherein said inlet means admit cold water to the bottom of said reservoir, and said outlet means discharge heated water from an outlet zone in an upper portion of said reservoir, and said current switching device is thermally coupled substantially to the bottom of said reservoir.

7. A hot water dispensing apparatus as defined in claim 5 wherein said current switching device comprises a triac.

8. A hot water dispensing apparatus comprising:

a hot water reservoir;

means including a resistance heating element within said reservoir operable from an applied electric current for heating water in said reservoir;

inlet means for controllably admitting cold water into said reservoir at a first predetermined flow rate;

outlet means for controllably discharging heated water from said reservoir at a second predetermined flow rate;

said first predetermined flow rate being less than said second predetermined flow rate;

means for providing a sensing signal indicative of the temperature of the water in said reservoir at said discharging means; and indicator means responsive to said sensing signal for indicating to a user the water temperature at said outlet means being above a predetermined threshold level.

9. A hot water dispenser as defined in claim 8 including a temperature regulating means responsive to the temperature of water in said reservoir for controlling the application of electric current to said resistance heating element to maintain the water in said reservoir at a substantially constant predetermined temperature.

10. A hot water dispenser as defined in claim 8 wherein said indicator means comprise an electric indicator lamp visible to a user.

11. A hot water dispenser as defined in claim 8 wherein said outlet means comprise a user-actuable faucet, and said indicator lamp is mounted in close proximity to said faucet.

12. A hot water dispensing apparatus comprising:

a hot water reservoir including an inlet zone at the bottom end thereof and an outlet zone in an upper portion thereof;

means including a resistance heating element within said reservoir operable from an applied electric current for heating water in said reservoir;

inlet means for admitting cold water into said reservoir at a first predetermined flow rate;

outlet means for discharging heated water from said reservoir at a second predetermined flow rate;

temperature regulating means responsive to the temperature of water in said reservoir for controlling the application of electric current to said resistance heating element to maintain the water in said reservoir at a substantially constant predetermined temperature;

said first predetermined flow rate being less than said second predetermined flow rate for maximizing the volume of said outlet zone;

said temperature regulating means including a switch device in series-circuit relationship with said resistance heating element and user-adjustable circuit means for periodically rendering said switch device conductive to control the temperature of water in said reservoir; and indicator means for indicating to a user the cycling of said switch device between conductive and non-conductive states to confirm temperature equilibrium in said reservoir.

13. A hot water dispensing apparatus as defined in claim 12 wherein said indicator means comprises a user-viewable electric indicator lamp.

* * * * *